US005346106A

United States Patent [19]

Ring

[11] Patent Number: 5,346,106

[45] Date of Patent: Sep. 13, 1994

[54] CONTAINER HAVING NO-GLUG POURING SPOUT

[75] Inventor: Carl D. Ring, Oakland, Tenn.

[73] Assignee: Ring Can Corporation, Oakland, Tenn.

[21] Appl. No.: 159,564

[22] Filed: Dec. 1, 1993

[51] Int. Cl.[5] ..... A47G 19/14

[52] U.S. Cl. ..... 222/465.1; 222/479; 222/564; 215/1 C; 215/100 A; 220/745; 220/771

[58] Field of Search ..... 222/465.1, 479, 468, 222/564; 215/1 C, 100 A; 220/745, 771

[56] References Cited

U.S. PATENT DOCUMENTS

| | | | |
|---|---|---|---|
| 308,106 | 11/1884 | Stimpson . | |
| 591,735 | 10/1897 | Brewer . | |
| 767,321 | 8/1904 | Wheldon . | |
| 1,062,118 | 5/1913 | Ritten . | |
| 2,581,150 | 1/1952 | Shore | 222/525 |
| 3,066,819 | 12/1962 | Cox | 215/1 |
| 3,198,367 | 8/1965 | Stickney | 215/1 |
| 3,214,052 | 10/1965 | Dike | 215/10 |
| 3,251,514 | 5/1966 | Speicher | 222/468 |
| 3,396,875 | 8/1968 | Finch | 222/456 |
| 3,410,459 | 11/1968 | Conley | 222/479 |
| 3,434,635 | 3/1969 | Mason, Jr. | 222/468 |
| 3,506,167 | 4/1970 | Orr | 222/479 |
| 4,412,633 | 11/1983 | Guerrazzi et al. | 222/468 |
| 4,804,119 | 2/1989 | Goodall | 222/468 |
| 4,838,464 | 6/1989 | Briggs | 222/478 |
| 4,860,927 | 8/1989 | Grinde | 222/465.1 X |
| 5,232,107 | 8/1993 | Krall et al. | 220/771 X |

FOREIGN PATENT DOCUMENTS 110547 12/1964 Netherlands .

OTHER PUBLICATIONS

PCT International Application No. PCT/NO85/00065, published Apr. 24, 1986, publication No. WO 86/02334. Photocopies of existing Quaker State motor oil bottle design with vent tube (Sample furnished upon request).

*Primary Examiner*—Gregory L. Huson
*Attorney, Agent, or Firm*—Nies, Kurz, Bergert & Tamburro

[57] ABSTRACT

A blow molded plastic container having a small diameter vent tube integrally molded on the top wall and forming an air vent passageway between the pouring spout opening and the chamber in the bottle. A substantially larger hollow handle, closed at both ends, is integrally molded on top of the vent tube in spaced relationship above the top wall to form a hand opening.

4 Claims, 2 Drawing Sheets

CONTAINER HAVING NO-GLUG POURING SPOUT

BACKGROUND OF THE INVENTION

This invention relates generally to containers for dispensing liquid and more specifically to a container having a novel pouring spout arrangement by which the space above the liquid is vented to permit air to be drawn into the space during a pouring operation to prevent the glugging or gulping phenomenon associated with many conventional bottles.

This invention is particularly applicable to larger blow-molded plastic jugs or bottles used for dispensing a variety of different types of liquids, some of which may be toxic or flammable. As the bottle is tipped forwardly, the mouth or neck portion will normally be lowered below the liquid level in the bottle, trapping the air in the bottle above the liquid. If no vent is provided to admit air into this region, the flow of liquid out of the bottle will alternate with the flow of air into the jug, causing a glugging or gulping action. Because of the glugging action the poured stream is difficult to control, so that the user may make a mess with the liquid. When that liquid is toxic or flammable this can create a dangerous situation.

In the past, various attempts have been made to provide large blow molded plastic containers in which the hollow handle forms a vent passageway between the spout and chamber in the bottle to overcome this glugging problem. Typical prior proposals are illustrated in U.S. Pat. Nos. 3,251,514, 4,412,633, 4,804,119, and in PCT International Publication No. WO-86/02334, and those designs are improvements over the conventional bottles. Another particularly effective novel design is illustrated in applicant's copending application Ser. No. 08/090,760.

In such bottles the hollow handle is sufficiently large in size so as to be comfortable and secure to grasp. Consequently, during the pouring operation some liquid may inadvertently flow back through the air passageway formed in the hollow handle and will collect within the handle if it doesn't all drain back into the chamber and the bottle. If the liquid is a hazardous waste material the liquid collected in the large sized hollow handle could be substantial in volume and this creates an undesirable handling and disposal problem of the bottle. The need exists for a solution to this problem.

SUMMARY AND OBJECTS OF THE INVENTION

Accordingly a primary object of this invention resides in the provision of a blow molded plastic bottle having a small diameter no-glug air vent tube forming an air passageway between the pouring opening and the spout and the liquid containing chamber in the bottle and a hollow handle closed at both ends.

Still another object of the invention resides in the provision of the above blow molded plastic bottle in which the vent tube is of small diameter and is integrally molded onto the outside of the top wall of the bottle, and the larger hollow handle is integrally mounted on top of the vent tube.

A further object of the invention resides in the provision of the above blow molded plastic bottle in which the hollow handle is integrally molded at its opposite closed ends by thin web sections to the front and rear ends of the vent tube.

Another object of the invention resides in the provision of the above plastic bottle which can be readily manufactured by a blow molding process.

Other objects and advantages will become apparent from reading the following detailed description of the invention in which reference is made to the accompanying drawings wherein like numerals indicate like elements.

DETAILED DESCRIPTION OF THE INVENTION

Figure 2:
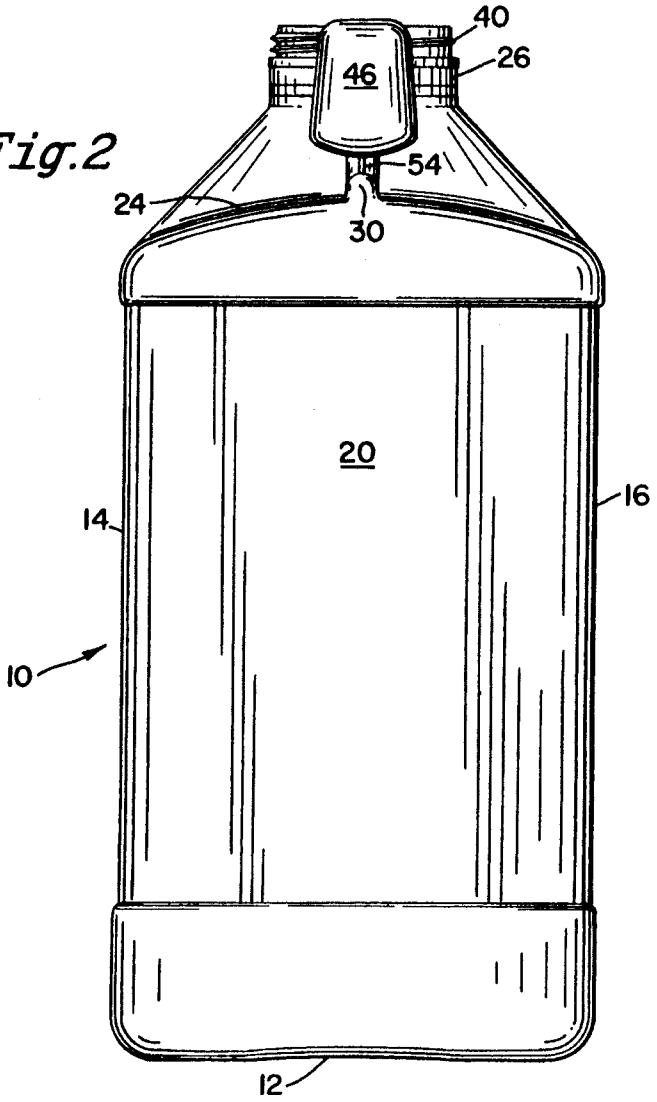
FIG. 2 is a rear elevational view of the bottle of FIG. 1.
Figure 1:
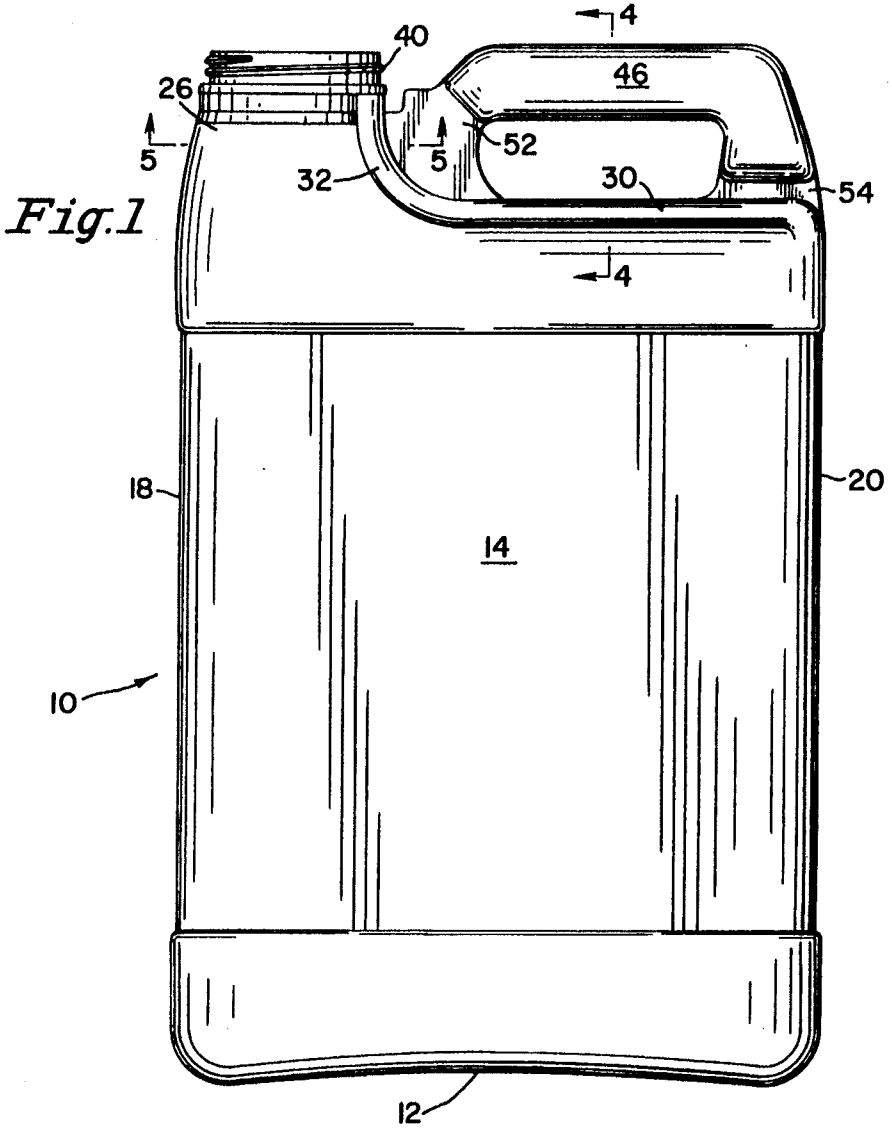
FIG. 1 is a side elevational view of the blow molded plastic bottle of the invention.
Figure 5:
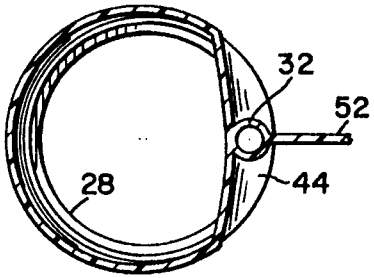
FIG. 5 is a fragmentary sectional view of the bottle taken along line 5—5 of FIG. 1.
Figure 6:
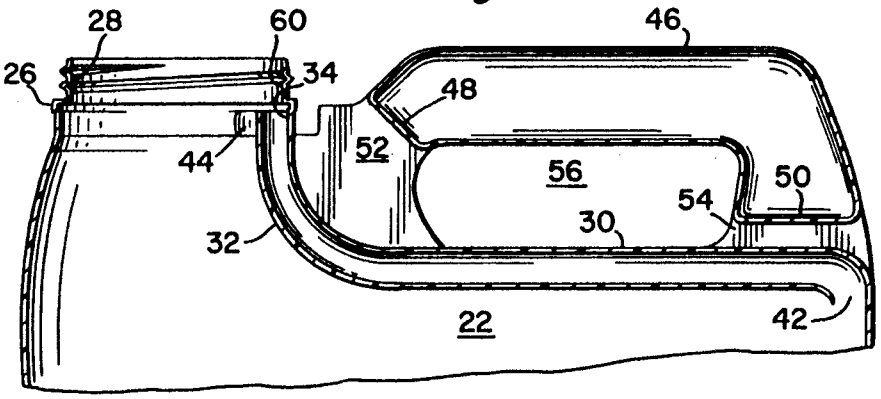
FIG. 6 is a fragmentary sectional view of the bottle taken along line 6—6 of FIG. 3.
Figure 3:
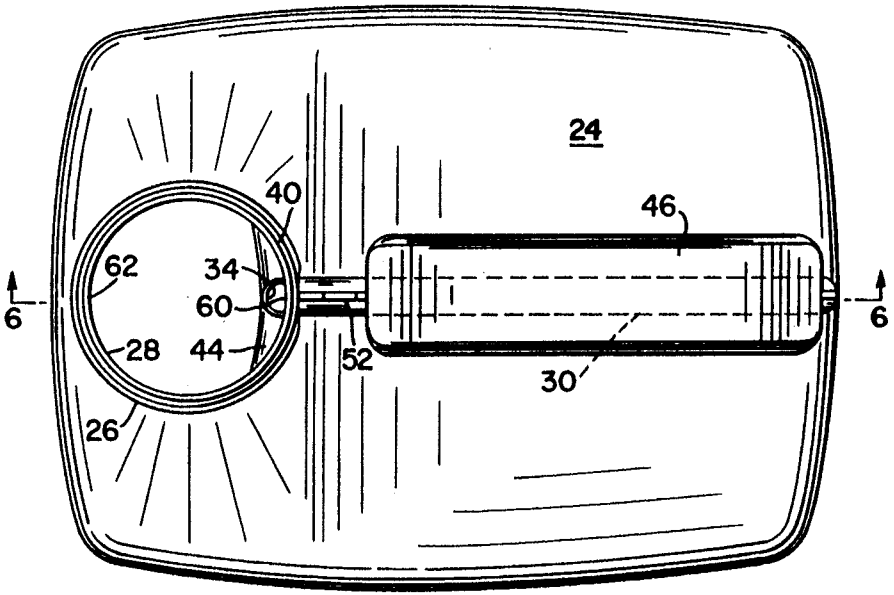
FIG. 3 is a top plan view of the bottle of FIG. 1.
Figure 4:
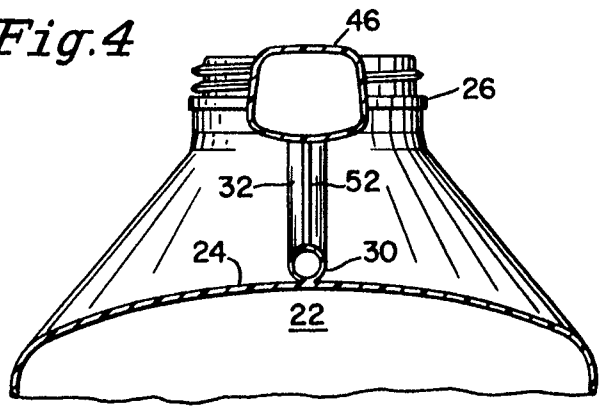
FIG. 4 is a fragmentary sectional view of the bottle taken along line 4—4 of FIG. 1.

The blow molded plastic container of the invention may be of rectangular cross section and includes a bottom wall 12, side walls 14 and 16, front wall 18 and rear wall 20 extending vertically upwardly from bottom wall 12 and defining a fluid containing chamber 22 which is closed by top wall 24. A spout 26 extends upwardly from top wall 24 adjacent front wall 18 and defines a circular pouring opening 28 through which the liquid in chamber 22 may be poured from the bottle. A threaded cap (not shown) normally closes opening 28 of spout 26.

To prevent a glugging action as described hereinabove during a pouting operation, a small diametered hollow vent tube 30 is molded integrally on top wall 24 and extends horizontally from rear wall 20 forwardly to an upwardly curved front section 32 formed with opening 34 which opens upwardly into spout opening 28 at a rear portion 40 of spout 26. The rear end 42 of vent tube 30 opens downwardly into communication with chamber 22.

A deflector ledge 44 extends transversely across the rear portion 40 of spout 26 directly adjacent tube opening 34.

An elongated hollow handle 46 of a size which is sufficiently large to be comfortably and securely grasped is closed at both ends 48 and 50. Thin pinched webbed sections 52 and 54 are integrally molded with and between handle ends 48 and 50 and the front and rear ends of vent tube 30. The webbed sections 52 and 54 mount the handle in spaced relation from vent tube 30 and top wall 24 to form hand opening 56.

To pour liquid from chamber 22 hollow handle 46 is grasped to tip bottle 10 forwardly. The liquid is deflected by ledge 44 away from the rear edge 60 of spout 26 and vent opening 34 and over front edge 62. Air enters opening 34 and passes through vent tube 30 and open rear end 42 into chamber 22 thereby preventing any glugging action. No liquid or air enters hollow handle 46. Virtually all of the liquid that may enter vent tube 30 during the pouring operation quickly drains back into chamber 22 when the bottle is placed upright. Because the diameter of tube 30 is so small the amount of liquid which may remain in the tube is very small. Consequently it presents no hazard upon disposal of the bottle.

In prior systems in which the substantially larger hollow handle served as part of the vent passageway the amount of liquid which might collect in the handle was substantially greater and, if it were a hazardous chemical it could present a problem upon disposal of the empty bottle.

Also the fact that the handle is mounted directly on top of vent tube 30 ensures that during the pouring operation the liquid is poured over front edge 62 and vent tube opening 34 remains open.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A blow molded plastic container comprising a bottom, side wall means extending upwardly from said bottom and defining therewith a chamber for containing a fluid, top wall means closing said chamber and having a spout forming an opening through which the fluid may be poured from said chamber, a hollow vent tube formed integrally on said top wall means and having a front open end communicating with said spout opening and a rear open end communicating with said chamber, a hollow handle closed at its front and rear ends, and means integrally connecting the front and rear ends of said handle on said vent tube.

2. The plastic container of claim 1, the front end of said vent tube opening upwardly into said spout.

3. The plastic container of claim 2, comprising deflector means extending across a rear portion of said spout opening adjacent the front end of said vent tube.

4. The plastic container of claim 1, said connecting means including first and second web strips connecting the front and rear ends of said handle on said vent tube and mounting said handle in spaced relation from said top wall means to form a hand opening.

* * * * *